United States Patent [19]

Young et al.

[11] 3,985,410

[45] Oct. 12, 1976

[54] MINIATURE BAR

[75] Inventors: Joseph P. Young; Sylvia Young, both of Seattle, Wash.

[73] Assignee: The Raymond Lee Organization, Inc., New York, N.Y. ; a part interest

[22] Filed: Aug. 11, 1975

[21] Appl. No.: 603,619

[52] U.S. Cl. ..... 312/306; 312/270; 312/272

[51] Int. Cl.[2] ..... A47B 51/00

[58] Field of Search ..... 312/221, 306, 272, 272.5, 312/270, 247, 291

[56] References Cited

UNITED STATES PATENTS

| | | | |
|---|---|---|---|
| 845,703 | 2/1907 | Randolph | 312/250 |
| 2,316,632 | 4/1943 | Smart | 312/272.5 |
| 2,710,093 | 6/1955 | Raker | 312/272.5 |

FOREIGN PATENTS OR APPLICATIONS

| | | | |
|---|---|---|---|
| 736,046 | 11/1932 | France | 312/176 |
| 838,175 | 2/1937 | France | 312/306 |
| 576,634 | 5/1958 | Italy | 312/272 |
| 372,939 | 5/1932 | United Kingdom | 312/272 |

*Primary Examiner*—Casmir A. Nunberg
*Assistant Examiner*—Victor N. Sakran
*Attorney, Agent, or Firm*—Howard I. Podell

[57] ABSTRACT

A bar table, the top of which is shaped as a polygon so as to fit an individual seat adjacent each side of the table. A storage section for bottles and glasses is mounted to the structure of the table top, which table top structure is slidably mounted in the table pedestal so that the table top structure may be elevated to expose the storage shelves or alternately, the table top structure may be slid inside the pedestal to enclose the shelf structure.

1 Claim, 3 Drawing Figures

MINIATURE BAR

SUMMARY OF THE INVENTION

Our invention is a bar table, the top of which is shaped as a polygon so as to fit an individual seat adjacent each side of the table. A storage section for bottles and glasses is mounted to the structure of the table top, which table top structure is slidably mounted in the table pedestal so that the table top structure may be elevated to expose the storage shelves or alternately, the table top structure may be slid inside the pedestal to enclose the shelf structure.

In the elevated position of the table top structure, spring mounted cams in the side of the table top structure, rotate so as to project beyond the sides of the elevated structure and rest on the top of the pedestal.

Shelves may be mounted in the rear sides of the pedestal and a door opening to the interior of the pedestal may be mounted as one panel of the pedestal.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
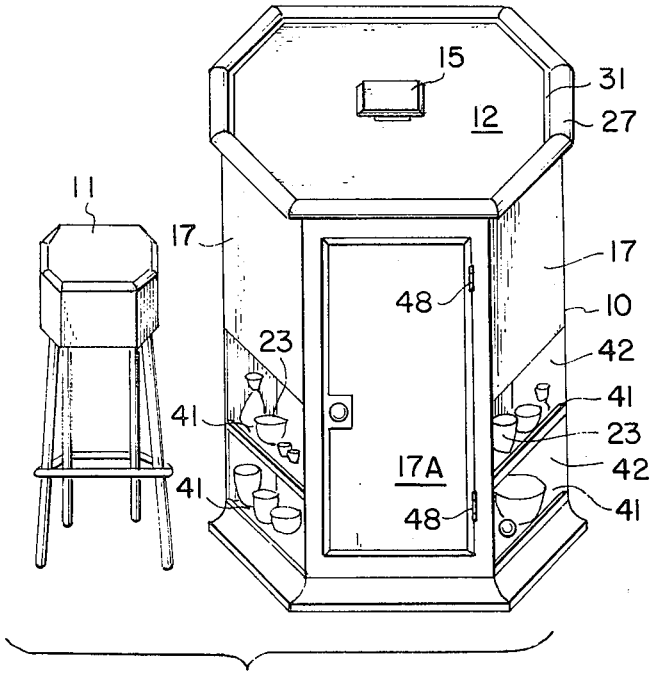
FIG. 1 is a perspective view of the invention.

Turning now descriptively to the drawings, in which similar reference characters denote similar elements throughout the several views, FIG. 1 illustrates the bar table 10 with a bar stool located adjacent one of the sides of the table 10. The table 10 is formed with a top panel 12 of an octagonal shape, which is fitted with a centrally located knob 15.

Figure 2:
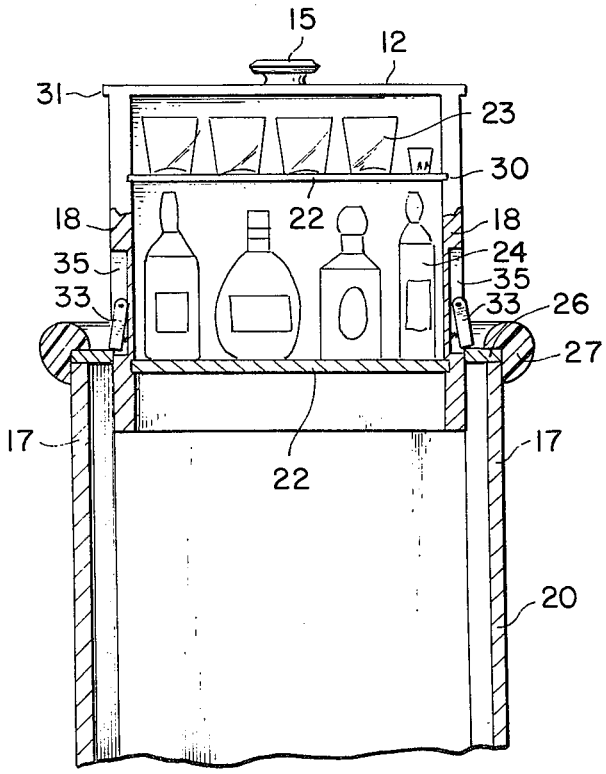
FIG. 2 is a sectional view of the table top in the elevated position.
Figure 3:
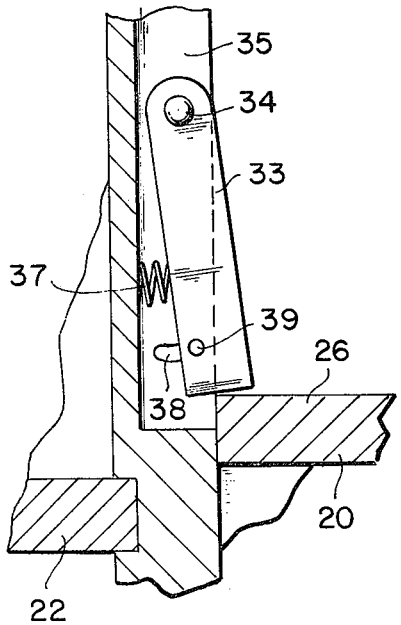
FIG. 3 is a fragmentary sectional view of the latch.

Top panel 12 is fitted to vertical wall members 18 under the panel 12, to form a table top section 30 which slides inside of the side panels 17 that form the vertical walls of the pedestal 20 of the table bar 10. Shelves 22 are mounted to wall members 18 for the storage of glasses 23 and bottles 24, with the shelves 22 open to access from the rear of the table top section 30 when the table top panel 12 is in the elevated position shown in FIGS. 2–3.

The top rim 27 of the pedestal unit is internally bounded by edging 26 that supports the projecting rim 31 of the table top panel 12 when the shelves 22 and panel walls 18 are concealed inside the pedestal panels 17. A plurality of cams 33 are individually pivotably mounted in external recesses 35 in panel walls 18 and biased by compression springs 37 to rotate away from the adjacent panel walls 18 so as to project beyond the panel wall 18 and furnish a foot upon which the walls 18 rest on the pedestal edging 26 when the table top panel 12 is lifted to the extended position shown in FIGS. 2–3. A slot 38 in the side of recess 35 engages a pin 39 fixed to each cam 33 to limit the extended rotational position of cam 33. Thus when table top 12 is manually lifted by knob 15, cams 33 spring out and release of knob 15 permits cams 33 to rest on pedestal edging 26 to support the exposed walls 18 and furnish access to shelves 22. Cams 33 may be manually rotated into recesses 35 to permit sliding of walls 18 and table top 12 to the depressed position shown in FIG. 1, in which the bottles 24 and glasses 23 are concealed.

Shelves 41 may be mounted in external recesses 42 in the lower sections of pedestal panels 17 for storage of glasses 23, and a panel 17A may be mounted by hinges 48 to serve as a door for obtaining access to the interior of pedestal 20 or to material stored on shelves 22 of the table top section 30, when the table top section 30 is in the depressed position.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A table bar assembly comprising, a hollow pedastal and a table top unit slidably mounted in the pedastal so as to travel along the vertical axis of the pedastal between an extended position in which the table top unit extends above the pedastal and a retracted position in which the table top unit is enclosed within the pedastal, said table top unit fitted with a top panel that serves as an exposed table platform for the assembly in both the said extended and said retracted positions said pedastal formed of a first number of first vertical panels oriented to form a polygon in horizontal cross-section, with one of said first vertical panels hinged to the pedastal along the vertical axis of the pedastal to form a door to the interior of the pedastal, said table top unit comprising a frame to which the table top panel and a shelf below the underside of the table top panel are mounted to a second number of second vertical panels extending below the underside of the said table top panel, with each of said second vertical panels aligned in a plane parallel to the plane of an adjacent first panel of the pedastal, in the assembled condition, with the said second number of second panels being one less than the said first number of first panels, so that the said second vertical panels of the table top unit, in horizontal cross-section form a polygon similar to the polygon formed by the pedastal vertical panels, with one vertical side of the table top unit polygon being open to provide access to the said shelf from one side of the assembly, while the remaining said second vertical panels serve to conceal the said shelf, such that in the extended position of the table top unit, above the pedastal, the assembly serves as a bar, with the shelf providing storage space accessible and visible from only one side of the assembly, and in the retracted position of the table top unit, inside the pedastal, the assembly serves as a table with access to the shelf of the table top unit provided by the door of the pedastal unit, said table top unit held in the extended position, by latching means fixed to a vertical panel of the table top unit.

* * * * *